United States Patent [19]

Tharp

[11] Patent Number: 4,960,546

[45] Date of Patent: Oct. 2, 1990

[54] DIFFUSER MOUNTING ARRANGEMENT FOR WASTE WATER AERATION SYSTEMS

[75] Inventor: Charles E. Tharp, 504 Stalcup, Columbia, Mo. 65201

[73] Assignee: Charles E. Tharp, Columbia, Mo.

[21] Appl. No.: 340,265

[22] Filed: Apr. 19, 1989

[51] Int. Cl.[5] ..... B01F 3/04

[52] U.S. Cl. ..... 261/122; 261/124; 285/197; 285/915

[58] Field of Search ..... 261/122, 124; 285/915, 285/197

[56] References Cited

U.S. PATENT DOCUMENTS

| | | | |
|---|---|---|---|
| 3,489,441 | 1/1970 | Malcolm | 285/197 |
| 3,501,133 | 3/1970 | Dreier et al. | 261/124 |
| 3,918,748 | 11/1975 | Acda | 285/197 |
| 3,953,553 | 4/1976 | Thayer | 261/122 |
| 3,976,314 | 8/1976 | Graham | 285/915 |
| 4,158,461 | 6/1979 | Francis | 285/197 |
| 4,273,364 | 6/1981 | de Lange | 285/197 |
| 4,391,458 | 7/1983 | Blakeley | 285/197 |
| 4,521,037 | 6/1985 | Knox | 285/915 |
| 4,563,277 | 1/1986 | Tharp | 261/122 |
| 4,818,446 | 4/1989 | Schreiber et al. | 261/122 |

FOREIGN PATENT DOCUMENTS 1404864 12/1972 United Kingdom ..... 261/124

*Primary Examiner*—Tim Miles

*Attorney, Agent, or Firm*—Kokjer, Kircher, Bradley, Wharton, Bowman & Johnson

[57] ABSTRACT

An improved mounting bracket for mounting diffusers on submerged air lateral pipes in a waste water treatment system. Each mounting bracket includes a pair of complemental saddle sections which can be clamped securely yet releasably on the air lateral with an outlet spout of the saddle in registration with a discharge port in the bottom of the air lateral. A Tee fitting has a pipe nipple connected with its inlet, and the pipe nipple can be threaded into the outlet spout. Virtually any type of diffuser can be solvent welded to each outlet of the Tee fitting. The mounting bracket surrounds and reinforces the air lateral at the diffuser connection point and takes advantage of relatively large diameter pipe at the threaded connection between the outlet spout and pipe nipple. All parts can be PVC or a similar plastic and can withstand the stresses which are applied because of the structural strength of the diffuser mounting arrangement.

18 Claims, 3 Drawing Sheets

DIFFUSER MOUNTING ARRANGEMENT FOR WASTE WATER AERATION SYSTEMS

BACKGROUND OF THE INVENTION

This invention relates in general to the aeration of waste water and more particularly to improvements in the mounting of diffusers on submerged air laterals in systems that treat municipal and industrial waste water.

A variety of diffusers have been used in waste water aeration, including fine bubble diffusers, flexible membrane diffusers, dome diffusers, porous tube diffusers and coarse bubble diffusers. The fine bubble diffusers are generally more efficient in transferring oxygen to the water, but they also have relatively high maintenance requirements. The coarse bubble diffusers are primarily applicable to low maintenance systems, while intermediate bubble systems represent a compromise between efficiency and maintenance requirements.

The aeration system typically includes submerged air laterals in the treatment basin arranged in the desired configuration. In the past, flexible membrane diffusers have typically been connected with the air laterals by a direct threaded connection between the diffuser and the lateral pipe. This requires outlets in the pipe which are internally threaded so that pipe nipples connected with the diffusers can be threaded into them. The major drawback with this diffuser mounting arrangement is that the air laterals must be constructed of heavy wall piping in order to provide enough threads to hold the diffuser in a cantilever position extending to the side of the lateral pipe. The need for heavy wall piping, whether stainless steel or polyvinyl chloride (PVC) adds significantly to the overall system cost.

In addition, the diffuser is subjected to turbulence, flexing, vibration and other forces while in service, and the stress applied to the diffuser connection is considerable. Ordinarily, the flexible membrane diffuser is about two feet long and the pipe nipple which connects to the air lateral is $\frac{3}{4}$ inch in diameter. As a consequence of the fatigue that results from long term operation of the diffusers, the connections have a fairly high failure rate and the pipe nipples are actually sheared off in some cases. Diffusers more than about two feet long are not used because the stress increases with length and longer diffusers are unable to withstand the added stress.

Threaded connections are also subject to damage to the threads caused by screwing the diffusers in and out during maintenance procedures. Threads in plastic fittings can be cross threaded or otherwise damaged by the mating threads, especially if the male threads are metal. Because plastic threads are lacking in durability, the diffusers can work loose and fall out. Stress applied to the diffuser can lead to enlargement of the hole and other deformations which can create air leaks, and continued operation of the diffuser under these conditions can unscrew the diffuser and eventually result in its complete detachment from the aeration system.

Another problem with the direct threaded connection is that the diffuser is difficult if not impossible to accurately level. If the holes which are drilled and tapped in the sides of the lateral pipes are angled from a true radial orientation, the outboard end of the diffuser will be higher or lower than the inboard end. Also, if the tapped hole is rotated slightly on the pipe from a position exactly to the side, the diffuser will extend at a slight incline and the outboard end will again be too low or too high. Tolerances on the threads also cause out of level orientations of the diffusers. If the diffuser is not level, the air distribution pattern is disturbed because the outboard end either receives too little or too much air depending upon whether it is too low or too high. If diffusers extend to both sides of the pipe, one may extend down slightly and the other may extend up slightly so that an unbalanced situation results and the air distribution suffers accordingly. Units that screw into the top of the pipe are also difficult to level and have unbalanced air flow when out-of-level.

In conventional systems, it is difficult to add or relocate the diffusers because of the need for a threaded opening in the side of the pipe at each different diffuser location. The openings must be made at the factory and cannot be made adequately in the field. Moreover, when the threads are fully tightened, the diffuser is not necessarily located with its bottom side facing downwardly as required for proper diffusion of the air. Thus, if the diffuser is to be properly oriented, it must often be either over-tightened or under-tightened, neither of which is desirable. Overtightening can strip the threads or damage another part of the assembly, while undertightening raises the possibility of the diffuser working itself loose and falling off of the air lateral due to vibrational forces or other forces applied to it in service. Units that require welded fittings are subject to similar problems.

Systems in which the diffusers connect directly to the sides of the lateral pipes necessarily locate the outlets on the horizontal center line of each pipe. When a large pipe four inches in diameter or more is used, the water is blown out only down to the level of the outlets. Consequently, separate water purge systems are needed to pump water out of the bottom half of the pipe in order for the aeration system to operate properly with minimum head loss. Such purge requirements add to the cost and complexity of the overall aeration system.

Tube type membrane diffusers are fully buoyant in that the entire diffuser is filled with air during normal operation. Although the fully buoyant system is easy and economical to produce, it also results in maximum stress being applied to the diffuser because the buoyant force on the diffuser is a function of the amount of water displacement which in turn depends upon the volume of the diffuser that is occupied by air. Therefore, in at least some applications, it is desirable to reduce the volume within the diffuser that is occupied by air in order to reduce the buoyancy stress to which the diffuser is subjected.

Coarse bubble diffusers are typically constructed of stainless steel, and they are often installed on stainless steel piping. Stainless steel diffusers and pipes are more costly than PVC and other plastics, and plastics are also less susceptible to corrosion problems. Again, direct threaded connections are sometimes used between the pipe and the pipe nipple of the diffuser, and this type of connection is lacking in structural strength. Adding or relocating diffuser units is difficult because the female outlet couplings must be factory welded to the stainless steel pipe. Leveling of the diffusers is also a problem caused by the manner in which they are connected to the air laterals.

In the past, various types of saddles have been proposed for effecting an outlet from an air header pipe. The known saddles that are constructed from PVC are solvent welded onto the top of the pipe with the saddles facing upwardly and having threaded outlets. Special flat plate diffusers are screwed directly into these outlets. Due to the solvent weld required to connect the saddle to the pipe, this type of saddle can be used only with PVC pipe and not with stainless steel or many other materials. Thus, when a particular application calls for stainless steel pipe, the saddles cannot be used. It is common for stainless steel straps to be used to secure the saddle, even when a glue connection is provided.

Conventional coarse bubble diffuser systems require an orifice between the air lateral and the diffuser in order to provide a pressure differential that prevents downstream diffusers from being deprived of significant air flow. The orifice is normally located in the inlet to the diffuser where it is subject to becoming clogged when the air is discontinued and waste water backs up into the diffuser. Solids that flow back through the orifice can become trapped and considerable amounts of debris can accumulate and cause flow disruptions.

SUMMARY OF THE INVENTION

The present invention is directed to a diffuser mounting arrangement which avoids the problems associated with prior systems. In accordance with the invention, a PVC saddle has two mating sections that hook together along one edge and may be secured along the other edge by a special fastener. One saddle section has an internally threaded outlet spout into which a threaded pipe nipple may be threaded. The other end of the pipe nipple is solvent welded to a fitting such as a "T" (or an elbow in some cases), and the "T" in turn connects with one or more diffusers which may be coarse bubble diffusers, fine bubble diffusers or intermediate bubble diffusers.

This mounting arrangement strengthens the pipe and allows thin wall pipe to be used for the air laterals, and this significantly reduces the cost of the piping. At the same time, the connection exhibits considerable strength both because the saddle surrounds and reinforces the pipe at the connection point and also because the threaded connection between the outlet spout and the pipe nipple extends along a substantial length and involves large diameter pipe (two inch diameter pipe at a minimum). In addition, the saddles can be installed in the field in any desired location and on virtually any type of pipe, including both stainless steel and PVC pipe. The diffusers can be accurately leveled simply by rotating the saddle to the proper orientation. The different types of diffusers can be installed on the same mounting brackets, so the diffusers are interchangeable to enhance the system flexibility and permit easy change over from one type of diffuser to another type of diffuser.

Another advantage is that the diffusers can be mounted either above or below the pipe depending upon the needs of the particular application in which they are employed. When mounted below the pipe, there is no need for a water purge system because the air outlets are at the low point of each air lateral. Flexible membrane diffusers can be used either in a fully buoyant mode or non-buoyant mode. Orifices for coarse bubble diffusers can be located either at the diffuser inlet or the pipe outlet, with the latter location being advantageous in most applications.

DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
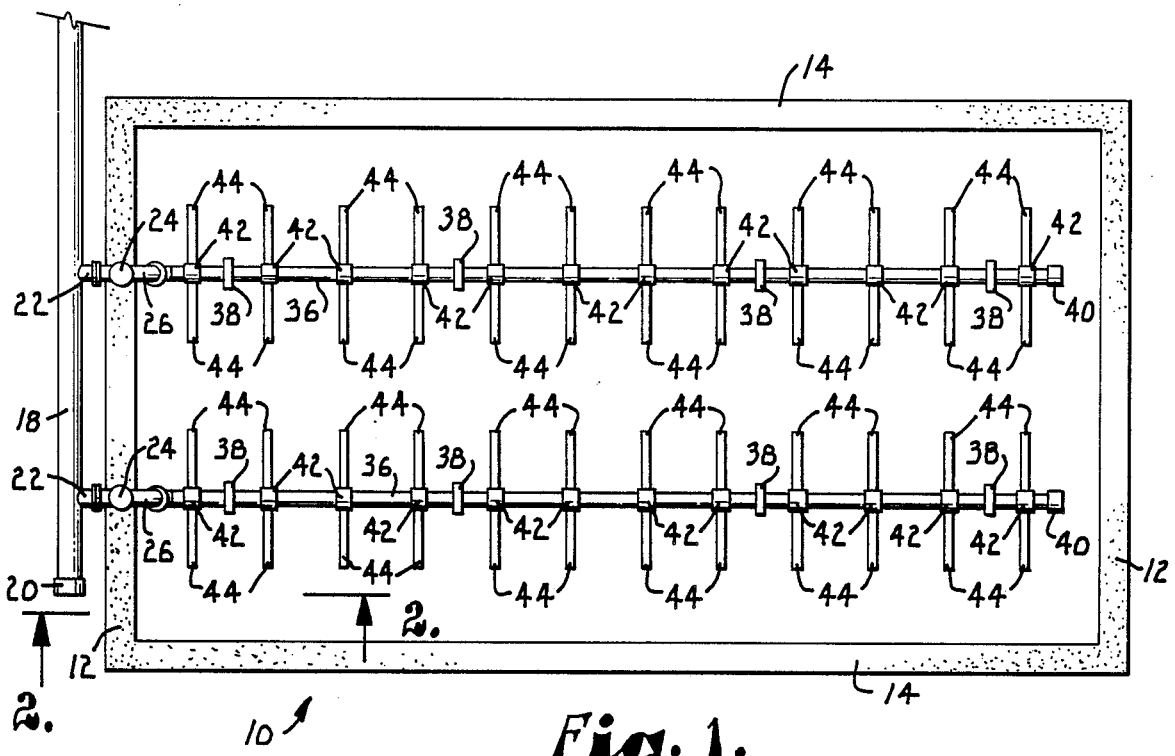
FIG. 1 is a top plan view showing a waste water treatment basin equipped with an aeration system employing two air laterals with duplex flexible membrane diffusers connected by mounting brackets constructed according to the present invention.
Figure 2:
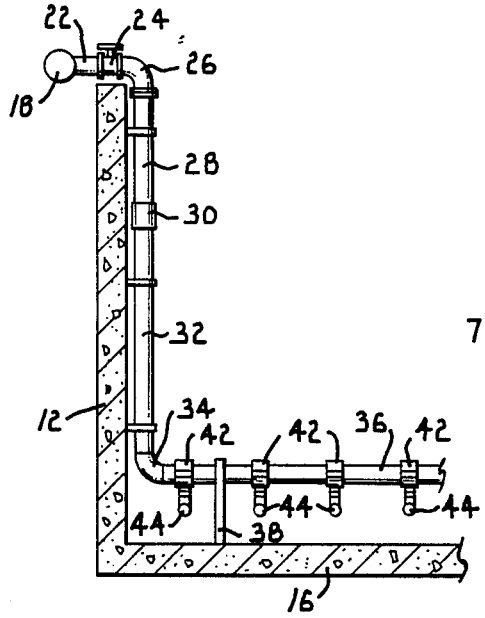
FIG. 2 is a fragmentary sectional view taken generally along line 2—2 of FIG. 1 in the direction of the arrows.

Referring now to the drawings in more detail and initially to FIG. 1, the present invention relates to a system for effecting the aeration of waste water contained in a basin 10. The basin 10 shown in the drawings is a concrete basin having concrete end walls 12, side walls 14 and a floor 16 (see FIG. 2). However, it should be understood that the present invention is applicable to systems installed in other types of basins, including earthen basins and even in steel tanks.

In order to aerate the waste water contained in the basin 10, compressed air is supplied to a main header pipe 18 having an end cap 20 on one end. Connecting with and branching away from the header pipe 18 at spaced apart locations are a plurality of branch pipes 22 which are two in number in the aeration system shown in FIG. 1. Each branch pipe 22 connects with a valve 24, and an elbow 26 connects with the opposite side of each valve. An upper drop pipe 28 which is typically constructed of metal has a flange connection with elbow 26 and is connected by a transition coupling 30 with a lower drop pipe 32 which may be a plastic pipe constructed of polyvinyl chloride (PVC) or another suitable material. The lower end of each drop pipe 32 is connected by an elbow 34 with a horizontal air lateral 36. The air laterals 36 extend parallel to one another near the floor 16 of the basin and are typically above the floor by a distance of between 6 inches and 36 inches. In accordance with a preferred embodiment of the present invention, the air laterals 36 may be thin walled polyvinyl chloride pipe, although other materials may also be used. The air laterals 36 are anchored to the concrete floor 16 by spaced apart pipe supports 38 which may be stainless steel or another suitable material. Each air lateral 36 is covered on one end with a cap 40.

In accordance with the present invention, special mounting brackets which are generally identified by numeral 42 are used to connect a plurality of diffusers with each of the air laterals 36. The diffusers may be of various types, including the tubular type flexible membrane diffusers identified by numeral 44 in FIGS. 1–6.

Figure 5:
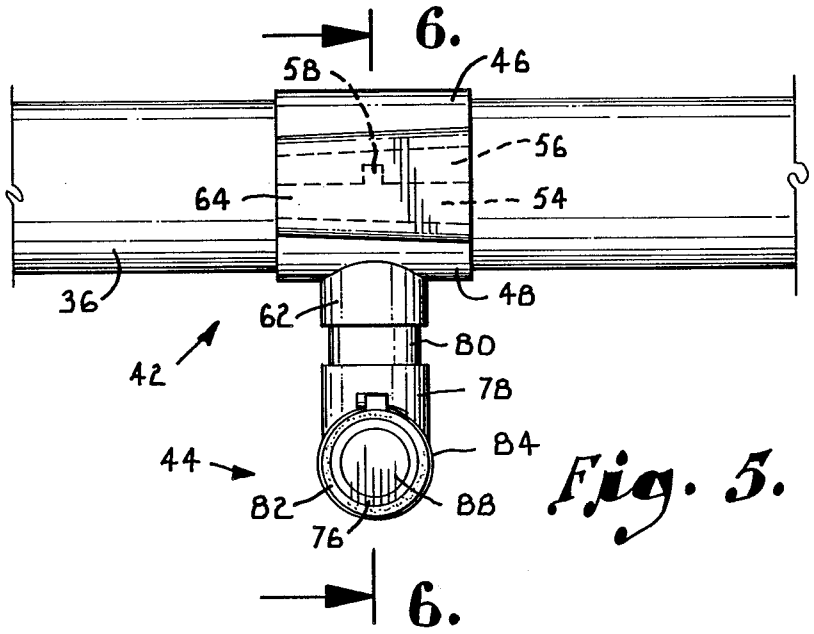
FIG. 5 is a fragmentary side elevational view on an enlarged scale showing one of the duplex diffuser assemblies mounted on an air lateral.
Figure 4:
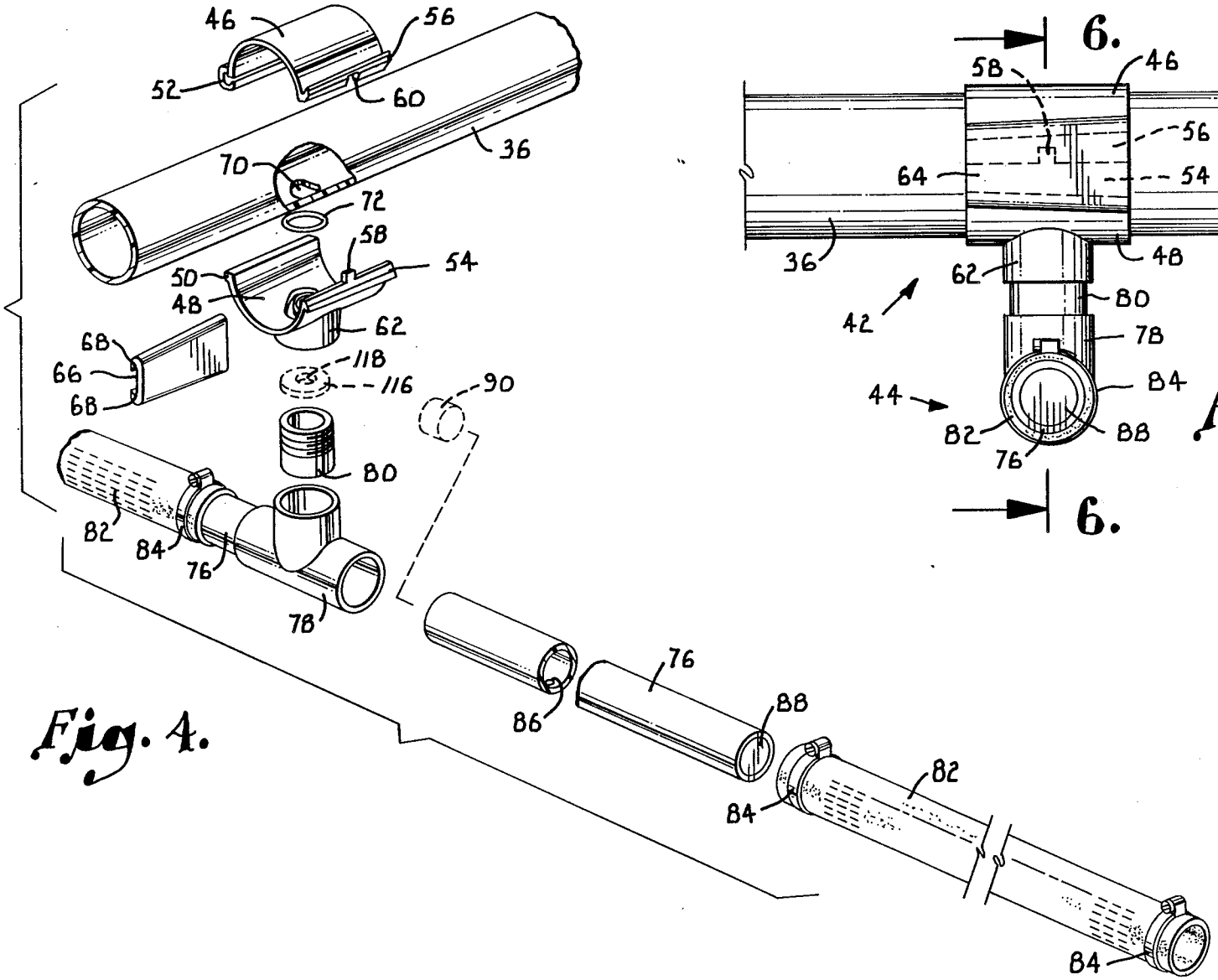
FIG. 4 is an exploded perspective showing the manner in which duplex diffusers may be connected with an air lateral in accordance with the present invention.
Figure 6:
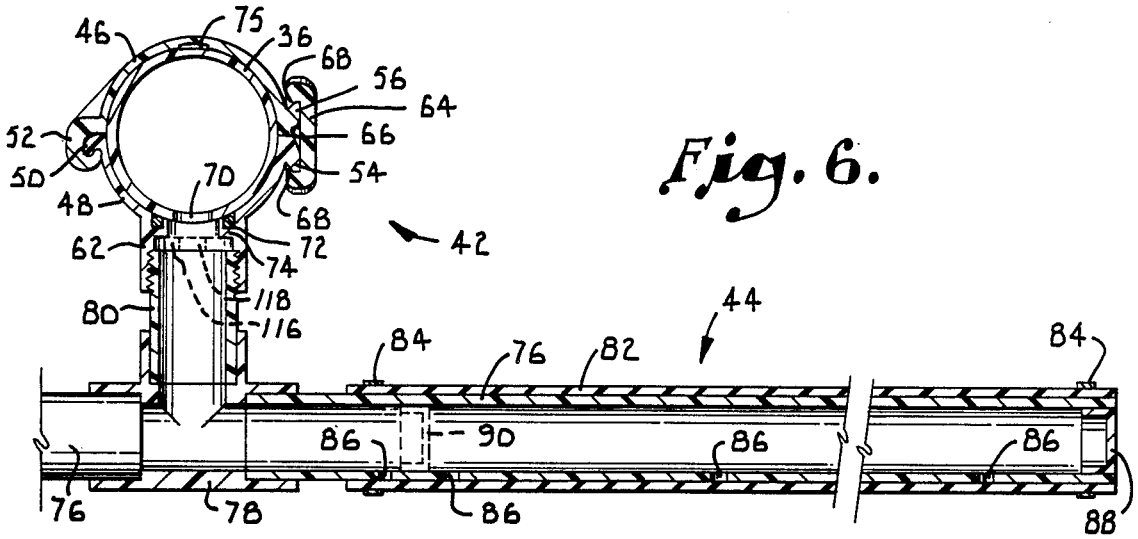
FIG. 6 is a fragmentary sectional view taken generally along line 6—6 of FIG. 5 in the direction of the arrows, with the break lines indicating continuous length.

With particular reference to FIGS. 4–6, each of the special mounting devices 42 includes a saddle type bracket formed by a pair of mating saddle sections 46 and 48. The two saddle sections 46 and 48 cooperate to form a cylinder having an inside diameter substantially equal to the outside diameter of the air lateral 36. Consequently, the saddle fits closely on the air lateral 36 when assembled. The body of section 48 is semi-cylindrical and one edge is provided with an outwardly projecting lip 50. The lip 50 has a size and shape to fit closely within a C shaped flange 52 formed on one edge of the other saddle section 46. The fit of lip 50 in flange 52 provides a hinge structure about which the saddle sections may be closed around the air lateral 36. The edge of saddle section 48 opposite the lip 50 is provided with a hook 54. A similar hook 56 is provided on the edge of saddle section 46 opposite the flange 52. A lug 58 projects from hook 54 and is received in a mating opening 60 formed in the other hook 56. An internally threaded spout 62 extends outwardly from the center of saddle section 48. The spout 62 is normally in the form of a cylindrical pipe having a diameter approximately 2 inches.

The saddle sections 46 and 48 are secured in the assembled condition on the air lateral 36 by a special fastener 64 which connects with the hooks 54 and 56. The fastener 64 is C shaped in section and includes a channel 66 which is bounded at the top and bottom by tapered lips 68. As best shown in FIG. 4, the fastener 64 is wider at one end than the other end and gradually tapers from end to end. The channel 66 likewise gradually increases in width from end to end. The saddle bracket and fastener 64 may conveniently be constructed of polyvinyl chloride or a similar material.

The saddle is applied to the air lateral 36 at the location of an opening 70 by slipping the saddle sections 46 and 48 onto the air lateral with lip 50 inserted in the flange 52, and closing the saddle sections on the air lateral until the hooks 54 and 56 are adjacent to one another. Then, the fastener 64 is applied to the hooks by applying the wide end of the channel 66 to the hooks and sliding the fastener lengthwise on the hooks until they are tightly engaged on the hooks, as shown in FIG. 6. In this manner, the saddle is securely clamped in place on the air lateral 36 and is rigidly thereafter held in place due to the clamping action provided by the fastener 64. It is noted that there are no straps or other stainless steel supports required to attach the saddle to the air supply piping, the saddle is adjustable simply by loosening the wedge assembly, and the saddle surrounds the complete diameter of the pipe to provide structural support and rigidity to the piping system.

Each saddle is applied to the air lateral 36 at a location such that the spout 62 is in alignment with an opening 70 which is drilled or otherwise formed in the bottom of the air lateral 36. Consequently, the air flows from the air lateral 36 through the opening 70 and into the spout 62. An O-ring 72 is located internally of the spout 62 and seals against the air lateral 36 around the opening 70. The O-ring 72 is compressed against the air lateral by a flange 74 located internally of the spout 62.

As best shown in FIG. 6, the inside surface of saddle section 46 may be provided with a thin friction strip 75 which acts to prevent the saddle from rotating axially on the pipe 36. The friction strip 75 has an adhesive backing which is pressed against saddle section 46 to secure the strip in place. The opposite surface of strip 75 contacts the pipe 36 and is provided with a high friction coating such as a rough grip in the nature of sandpaper. The high friction coating is able to grip against the outside surface of pipe 36 to prevent the saddle from turning even if the pipe is relatively smooth. The strip 75 provides rotation resistance which is especially important on smaller diameter pipes where the surface area of contact with the saddle is relatively small.

Each diffuser 44 includes a PVC pipe 76 having one end inserted into and solvent welded to one of the outlets of a PVC Tee fitting 78. The inlet to the Tee fitting 78 receives one end of a PVC pipe nipple 80 which is solvent welded to the Tee fitting. The opposite end of the pipe nipple 80 is externally threaded, and the threads mate with the internal threads of the spout 62.

In this manner, the diffusers 44 are mounted on the air laterals 36, and each spout 62 supplies air to the flow passage within the Tee fitting 78 and to the two diffusers 44 which connect with the Tee fitting. The air from the air lateral is supplied through the pipe opening 70, the spout 62, the nipple 80 and the Tee fitting 78 to the pipes 76 which form parts of the two diffusers.

Each diffuser 44 includes a flexible rubber membrane 82 which is sleeved onto the corresponding pipe 76 and tightened thereon by hose clamps 84 or another suitable means. The membrane 82 is porous and receives air which discharges through ports 86 which are spaced apart along the bottom of each pipe 76. The air that passes through the ports 86 discharges into the waste water through the small pores that are presented in the membrane 82, and the air is thus applied to the waste water in the form or medium or fine bubbles.

The diffusers 44 may be arranged as fully buoyant diffusers in which the entirety of the diffuser is filled with air in normal operation. An end plug 88 is threaded in the end of each pipe 76 remote from the Tee fitting 78, and the air that enters the pipe 76 is thus able to occupy the entire interior region of the diffuser. The diffusers 44 can also be arranged to function in a non-buoyant mode by solvent welding another plug 90 in each tube 76 at the location indicated by broken lines in FIG. 6. Since the plug 90 is only a short distance from the Tee fitting 78, the air is able to occupy only a small part of the inboard end of each diffuser 44, and the buoyant force exerted on the diffusers is decreased markedly. There should be at least one opening 86 located inboard of the plug 90 so that air is still able to discharge through that port and then through the pores in the flexible membrane 82.

It should be noted that the membrane 82 is not porous or perforated at the points adjacent to each port 86 as a check valve in order to prevent significant inflow into the pipe 76 when the air is turned off. The membrane then closes off and seals the ports 86 so that separate check valves are not required.

The mounting devices 42 can be quickly and easily installed in the field, and the diffusers can easily be adjusted or relocated. In addition, diffusers can easily be added.

In order to mount a pair of diffusers 44 in tandem, the hole 70 is first formed at the proper location, and the mounting device 42 is then applied to the air lateral in the manner previously indicated. Normally, the spout 62 will direct the air straight downwardly from the bottom of the air lateral. Proper vertical orientation of the spout 62 is important in order to achieve leveling of the two diffusers 44 which are connected to it. If the diffusers are out of level, all that needs to be done to level them is to rotate the saddle on the air lateral until the spout 62 points straight downwardly, and a horizontal orientation of both diffusers is then assured.

The mounting devices are also strong enough to withstand the considerable forces to which the diffusers are subjected while in service. The pipe nipple 80 is at least a full 2 inch diameter pipe, and it therefore exhibits considerable strength along with the similarly sized spout 62 and Tee fitting 78. At the same time, the mating threads of the spout 62 and nipple 80 are in contact with one another over a considerable length to thus provide a strong connection.

Figure 3:
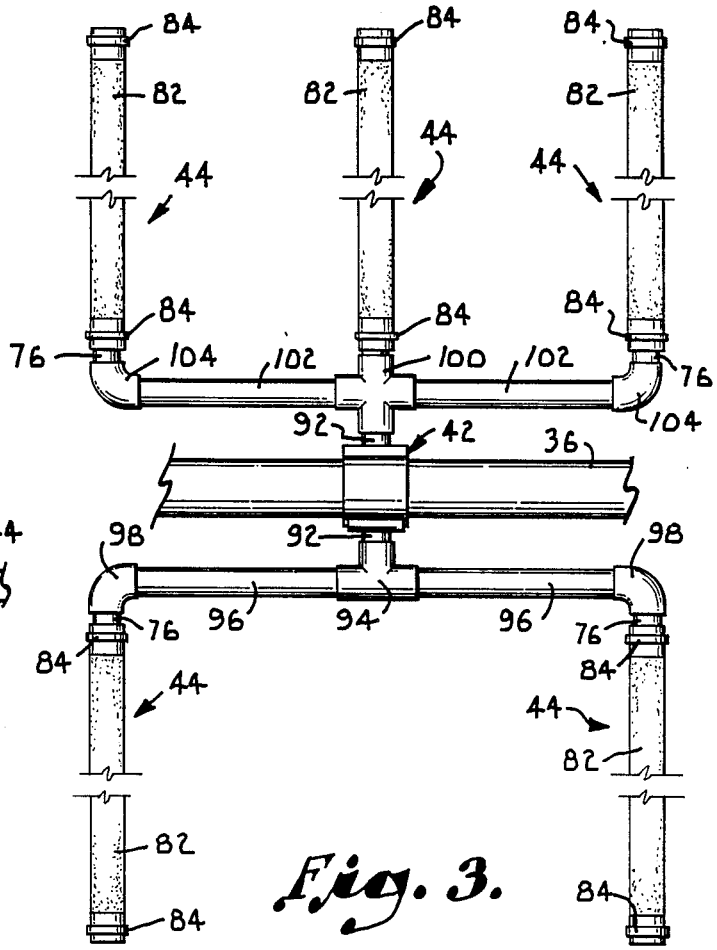
FIG. 3 is a fragmentary top plan view showing schematically how the flexible membrane diffusers may be arranged in either a fourplex or sixplex installation in a waste water aeration system.

While the diffusers 44 are typically mounted in the duplex arrangement shown in FIG. 6, with one diffuser extending to each side of the air lateral 36, other diffuser configurations are possible. For example, FIG. 3 shows for illustrative purposes an arrangement where the mounting device 42 is used to mount two diffusers on one side of the pipe and three additional diffusers on the other side of the pipe. This drawing is schematic in that for purposes of balance and stress stabilization, an actual installation would be either a duplex, a fourplex (two diffusers on each side of the pipe), or a sixplex (three diffusers on each side of the pipe). In either the fourplex or sixplex arrangement, short PVC pipes 92 are solvent welded in the opposite ends of the Tee fitting 78. In the fourplex arrangement (shown in the lower half of FIG. 3), each pipe 92 is solvent welded in the inlet of another Tee fitting 94, and the two outlets of the Tee fitting 94 receive and are solvent welded to additional pipes 96 that connect by solvent welding to elbows 98 at the their opposite ends. The two diffusers 44 are solvent welded to the elbows 98 in the manner indicated previously.

In the case of a sixplex arrangement (shown in the upper half of FIG. 3), each pipe pipe 92 is solvent welded to the inlet of an X fitting. One diffuser 44 is solvent welded to one of the three outlets of the X fitting 100. The other two outlets of fitting 100 are solvent welded to pipes 102 which are at least two inch diameter pipes connected at their opposite ends with elbows 104. One of the diffusers 44 is solvent welded in the normal manner to each of the elbows 104.

It should be evident that additional diffuser configurations are possible and that the same mounting device 42 can be used regardless of the number of diffusers and their specific arrangement.

Figure 7:
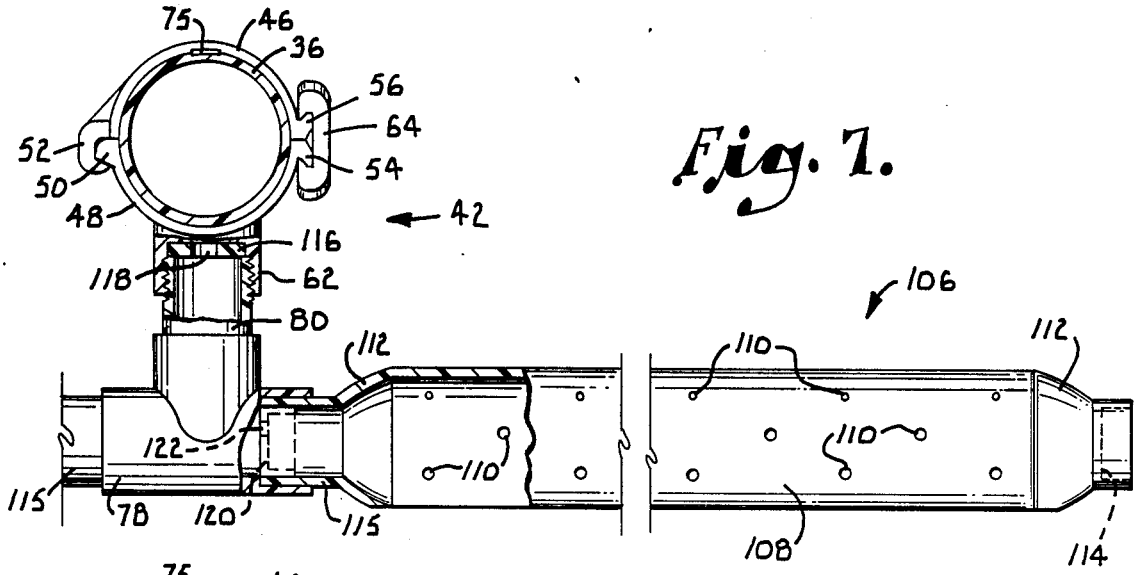
FIG. 7 is a fragmentary sectional view similar to FIG. 6, but showing a coarse bubble diffuser in place of the flexible membrane diffuser.

It is also an important feature of the invention that the mounting device 44 can be used to mount other types of diffusers to the air laterals 36. For example, FIG. 7 shows the mounting device 44 used to mount a pair of coarse bubble diffusers 106 on the air lateral 36. Each diffuser 106 is constructed wholly of PVC or another plastic, and each diffuser has a body 108 having the shape of an inverted "U" in section. Each body is open at the bottom and includes air outlets 110 arranged in plural rows each at a different level. The outlets 110 in the top row are somewhat smaller than the other outlets. Each end of the body 108 is provided with a transition 112 which is integral with the body 108 and which provides a transition from the "U" shaped body 108 to a cylindrical configuration. The outboard end of each diffuser 106 is closed by a plug threaded 114. The opposite or inboard end of each diffuser 106 has a cylindrical neck 115 (at least three inches in diameter) extending from the transition portion 112. The neck 114 is inserted in and factory solvent welded to the corresponding outlet of the Tee fitting 78 to assure proper orientation, etc.

It is necessary to effect a pressure drop between the air lateral 36 and the coarse bubble diffuser 106, and the pressure drop is ordinarily provided by an orifice. The orifice may be provided in one of two ways in accordance with the present invention.

Preferably, a flat circular plate 116 may be inserted into the spout 62 and held therein when the pipe nipple 80 is threaded into the spout. The plate 116 is then held between the flange 74 and the end of the pipe nipple 80. An orifice 118 is provided in the center of plate 116 to provide a pressure drop on the downstream side of the orifice.

Alternatively, the neck 115 on the inlet end of the diffuser 108 may be provided with a PVC plug 120 which may be solvent welded in the neck 115. The plug 120 has an orifice 122 which provides a pressure drop between the Tee fitting 78 and the diffuser 106.

If the orifice is located in the inlet end of each diffuser, as occurs with orifice 122, waste water can back up into the diffuser and the Tee fitting 78 when the air is shut off. Solids and other debris may thus be carried through the orifice with the waste water back up, and the debris may accumulate inside of the Tee fitting to possibly clog up the air flow path when the flow of air is resumed. For this reason, it is normally preferred for the orifice to be located in the vertical piping between the air lateral and the Tee fitting, as occurs with the orifice 118. Then, the tendency for any solid material to back up through the orifice is minimized. In addition, the plate 116 is accessible and may be removed and cleaned simply by unscrewing the pipe nipple 80. The orifice size can also be changed by substituting a different plate having a different orifice size.

As shown in FIG. 5 and 6, the plate 116 may also be installed in the spout 62 when the flexible membrane diffusers 44 are employed. However, the flexible membrane diffuser normally does not require a separate orifice because it has distribution openings through the support pipe and fine openings through the membrane which create enough head loss through the membrane to provide the function of an orifice.

Figure 8:
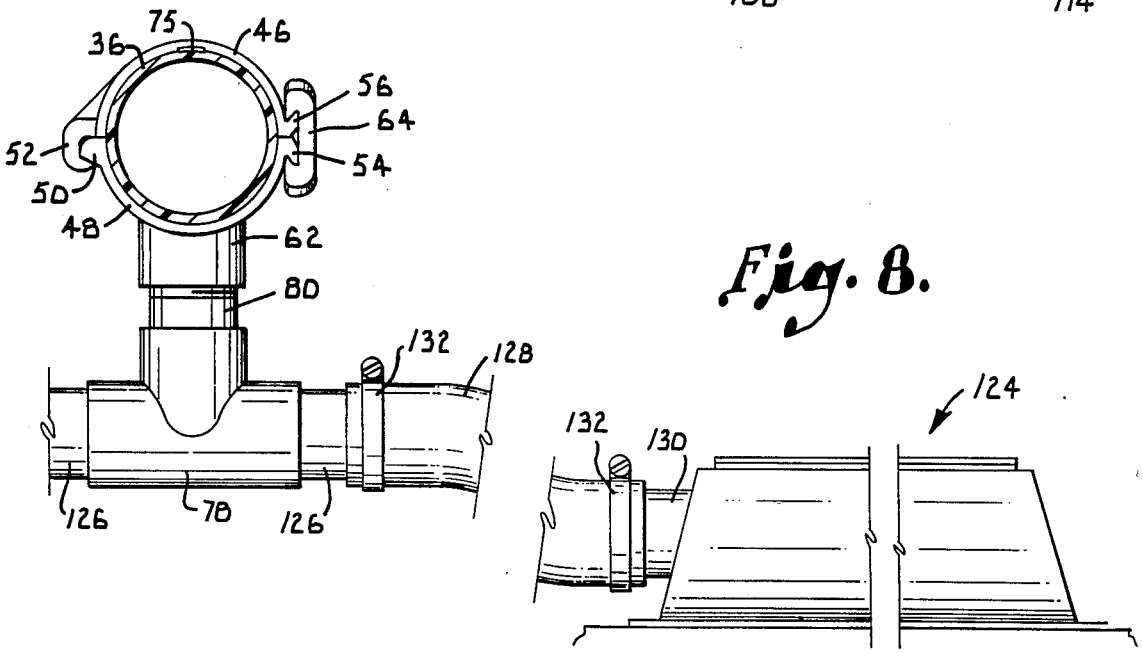
FIG. 8 is a fragmentary sectional view similar to FIG. 6, but showing a fine bubble diffuser in place of the flexible membrane diffuser.

FIG. 8 illustrates the mounting device 42 used to connect to the air lateral 36 a pair of fine bubble diffusers 124. The fine bubble diffusers 124 may be of the type disclosed in U.S. Pat. No. 4,563,277 which issued to Charles E. Tharp on Jan. 7, 1986 and to which reference may be made for a description of the details of the diffuser 124. In the arrangement shown in FIG. 8, a short PVC pipe 126 extends from each outlet of the Tee fitting 78. A flexible conduit 128 is slipped over pipe 126 at one end and is slipped at the opposite end over an inlet fitting 130 to the diffuser 124. Hose clamps 132 are used to secure the flexible conduit 128 on the pipe 126 and the inlet fitting 130. Because the diffuser 124 is a fine bubble diffuser, there is ordinarily no need for an orifice to provide flow balancing between diffusers. However, if an orifice is required for some reason, the orifice can be located in the spout 62 as previously indicated.

Because of the large diameter of the saddle which forms the body portion of mounting device 42, the saddle provides considerable structural reinforcement at the point of attachment of the diffusers. Consequently, the air laterals may be constructed of thin wall pipe and still exhibit the necessary structural strength. This results in a considerable economical advantage in that thick wall pipe is not required for the air laterals. Even so, it should be noted that the mounting device 42 can be installed on thick wall plastic pipe, stainless steel piping and any other type of piping having an outside diameter the same as standard iron piping. In an aeration system which employs one type of diffuser, the diffusers can be easily changed if necessary, and it is also easy to change from one type of diffuser to another type of diffuser. This is possible because the diffusers can be removed simply by unthreading the pipe nipple 80 from the spout 62 and also because the same mounting device 42 is used to mount the different types of diffusers.

Although the mounting arrangement will normally mount the diffusers below the air lateral as shown in the drawing, the diffusers can easily be mounted on top of the air lateral, on either side, or at any other desired location. When mounted below the pipe as shown in the drawings, there is no need for a water purge system because the air holes 70 are located at the lowest points of the air lateral 36.

It is thus apparent that the mounting arrangement of the present invention achieves all of the advantages of conventional diffuser mounting arrangements, and that it achieves additional advantages that other systems are incapable of achieving, particularly in the areas of strength, system flexibility, diffuser leveling capability, cost advantages and low pressure loss through large diameter inlets.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention I claim:

1. In a waste water aeration system having a submerged pipe supplied with air under pressure, the improvement comprising;

means for providing an outlet port in said pipe for discharging air therefrom;

a mounting saddle comprising first and second saddle sections, said first saddle section having an outlet fitting thereon;

means for clamping said first and second saddle sections on the pipe with said outlet fitting in registration with said outlet port to receive air therefrom and with said saddle sections surrounding said pipe for structural reinforcement thereof at the outlet port location;

a diffuser Tee fitting providing a flow passage therethrough and having an inlet and a pair of axially aligned outlets;

means for establishing a threaded connection between said outlet fitting and the inlet of said diffuser Tee fitting to mount the diffuser fitting with said flow passage disposed to receive air from the outlet fitting; and an elongate tubular diffuser connected with each outlet of said diffuser Tee fitting in a manner to receive air from said flow passage, each diffuser having means for discharging air into the waste water in bubbles and said diffusers extending horizontally in opposite directions from the outlets of said Tee fitting.

2. The improvement of claim 1, wherein;

each saddle section has opposite first and second edges, said first edges of the saddle sections mating together to form a hinge about which the saddle sections may be closed onto the pipe; and said clamping means comprises a fastener applicable to the second edges of said saddle sections in a manner to secure said second edges together.

3. The improvement of claim 2, wherein said fastener presents a tapered channel receiving said second edges and arranged to tighten thereon when the fastener is moved along the second edges.

4. The improvement of claim 1, wherein said means for establishing a threaded connection comprises a pipe nipple connected with said inlet of the Tee fitting and having a threaded connection with said outlet fitting of the first saddle section.

5. The improvement of claim 4, wherein said pipe nipple and said Tee fitting are plastic and are connected by a solvent weld connection; and each diffuser has a plastic portion connected with the corresponding Tee fitting outlet by a solvent weld connection.

6. The improvement of claim 1, wherein each of said diffusers comprises;

a tube having opposite ends, one end of each tube being connected with the corresponding outlet of the Tee fitting;

a porous flexible membrane sleeved on said tube and secured thereto; and port means in said tube for directing air therefrom into the membrane whereupon the air passes through the membrane and discharges therefrom in the form of bubbles.

7. The improvement of claim 6, wherein said Tee fitting and both tubes are plastic; and said tubes have solvent weld connections to said Tee fitting.

8. The improvement of claim 6, including means for closing the end of each tube opposite said one end to permit air to fill the tube along substantially the entire length thereof.

9. The improvement of claim 6, including a plug in each tube at a location intermediate the opposite ends thereof to permit the tube to fill with air only between said plug and said one end of the tube.

10. The improvement of claim 1, wherein said Tee fitting is plastic and each of said diffusers comprises:

an elongated diffuser body constructed of plastic and having one end connected with the corresponding outlet of the Tee fitting by a solvent weld connection; and a plurality of outlet ports in said diffuser body through which air discharges in the form of relatively coarse bubbles.

11. The improvement of claim 10, including orifice means between said pipe and each of the diffuser bodies.

12. The improvement of claim 11, wherein said orifice means comprises an orifice plate in aid outlet fitting.

13. The improvement of claim 12, wherein said orifice plate is removable from the outlet fitting and is held therein by said diffuser fitting upon tightening of said threaded connection.

14. Aeration apparatus for a waste water treatment system having a submerged pipe presenting an air outlet port, said aeration apparatus comprising:

a pair of saddle sections applicable to the pipe in surrounding relationship thereto, one of said saddle sections having an internally threaded outlet spout;

means for clamping said saddle sections on the pipe with said outlet spout communicating with said port to receive air therefrom and with the saddle sections surrounding the pipe to provide structural reinforcement therefor;

means for sealing said spout to the pipe;

an externally threaded pipe nipple threaded into said outlet spout;

a diffuser fitting connected to said nipple to receive air therefrom; and at least one elongate tubular diffuser connected to said diffuser fitting to receive air therefrom and discharge the air in bubbles into the waste water for aeration thereof, said diffuser extending generally horizontally from the diffuser fitting and applying vibrational loads to the fitting and pipe when air is discharged from the diffuser into the waste water.

15. The aeration apparatus of claim 14, wherein said pipe nipple and said diffuser fitting are plastic and are connected by a solvent weld connection; and said diffuser includes a plastic portion connected with said diffuser fitting by a solvent weld connection.

16. The aeration apparatus of claim 15, wherein said diffuser fitting comprises a Tee fitting having an inlet connected with said pipe nipple by a solvent weld connection and a pair of outlets one of which is connected with said plastic portion of said one diffuser by a solvent weld connection, and including a second diffuser having a plastic portion connected with the other outlet of said Tee fitting by a solvent weld connection such that said diffusers extend horizontally in opposite directions from said Tee fitting in alignment with one another.

17. In a waste water treatment system having a plurality of air lateral pipes submerged in waste water in a basin and a plurality of elongate tubular diffusers for discharging air bubbles into the basin, an improved diffuser mounting arrangement comprising;

a pair of complementary saddle sections applicable to each air lateral pipe in surrounding relationship thereto;

a threaded plastic outlet spout on one of said saddle sections;

an air outlet port in one of the air lateral pipes;

means for clamping said saddle sections on said one pipe with said spout in communication with said port to receive air therefrom and with said saddle sections surrounding said one pipe to structurally reinforce it;

a plastic diffuser fitting having a threaded conduit which may be threaded to said outlet spout to receive air therefrom, said diffuser fitting having a body presenting a flow passage communicating with said conduit to receive air therefrom; and means for connecting at least one of the diffusers with said diffuser fitting to mount the diffuser thereon in communication with said flow passage with the diffuser extending generally horizontally from the diffuser fitting, said connecting means comprising a plastic tube connected with said one diffuser and having a solvent weld connection with said diffuser fitting.

18. The diffuser mounting arrangement of claim 17, including a friction strip on one of said saddle sections at a location to apply a frictional force to the pipe resisting rotation of said saddle section on said one pipe.

* * * * *

US004960546B1

REEXAMINATION CERTIFICATE (2837th)

United States Patent [19] [11] B1 4,960,546

Tharp [45] Certificate Issued Apr. 9, 1996

[54] DIFFUSER MOUNTING ARRANGEMENT FOR WASTE WATER AERATION SYSTEMS

[75] Inventor: Charles E. Tharp, Columbia, Mo.

[73] Assignee: Environmental Dynamics, Inc., Boone County, Mo.

Reexamination Request:
No. 90/003,863, Jun. 16, 1995

Reexamination Certificate for:

| | |
|---|---|
| Patent No.: | **4,960,546** |
| Issued: | **Oct. 2, 1990** |
| Appl. No.: | **340,265** |
| Filed: | **Apr. 19, 1989** |

[51] Int. Cl.[6] ..... B01F 3/04

[52] U.S. Cl. ..... 261/122.1; 261/124; 285/197; 285/915

[56] References Cited

U.S. PATENT DOCUMENTS

| | | | |
|---|---|---|---|
| 3,530,990 | 9/1970 | Grimshaw | 210/199 |
| 4,818,446 | 4/1989 | Schreiber | 261/122 |

OTHER PUBLICATIONS

Munters, "Nokia Fine Bubble Aeration" brochure published prior to Apr. 19, 1988, Exhibit A to Harlan D. Jurgensen Declaration.

Aeration Technologies, Inc., "Aermax™ TPD High Efficiency Diffusers" brochure published prior to Apr. 19, 1988, Exhibit A to R. Gary Gilbert Declaration.

Aeration Technologies, Inc., "Aermax TPD Diffuser—D Series" illustration published prior to Apr. 19, 1988, Exhibit B to R. Gary Gilbert Declaration.

Cal Am Manufacturing, untitled promotional letter from Timothy M. Aitken to "Mr. Engineer" published prior to Apr. 19, 1988, Exhibit A to W. Sidney Aitken Declaration.

Cal Am Manufacturing, "Clamp It™ PVC Tapping Saddles . . . " brochure published prior to Apr. 19, 1988, Exhibit B to W. Sidney Aitken Declaration.

Cal Am Manufacturing and John W. Lambert, Ph.D., "Product Evaluation" promotional paper published prior to Apr. 19, 1988, Exhibit C to W. Sidney Aitken Declaration.

Envirex, "Bulletin No. 315–14C1" published prior to Apr. 19, 1988, Exhibit 1 to Lawrence B. Ratzlow Deposition.

Envirex, "Bulletin No. 315–14C2" published prior to Apr. 19, 1988, Exhibit 2 to Lawrence B. Ratzlow Deposition.

*Primary Examiner*—Tim R. Miles

[57] ABSTRACT

An improved mounting bracket for mounting diffusers on submerged air lateral pipes in a waste water treatment system. Each mounting bracket includes a pair of complemental saddle sections which can be clamped securely yet releasably on the air lateral with an outlet spout of the saddle in registration with a discharge port in the bottom of the air lateral. A Tee fitting has a pipe nipple connected with its inlet, and the pipe nipple can be threaded into the outlet spout. Virtually any type of diffuser can be solvent welded to each outlet of the Tee fitting. The mounting bracket surrounds and reinforces the air lateral at the diffuser connection point and takes advantage of relatively large diameter pipe at the threaded connection between the outlet spout and pipe nipple. All parts can be PVC or a similar plastic and can withstand the stresses which are applied because of the structural strength of the diffuser mounting arrangement.

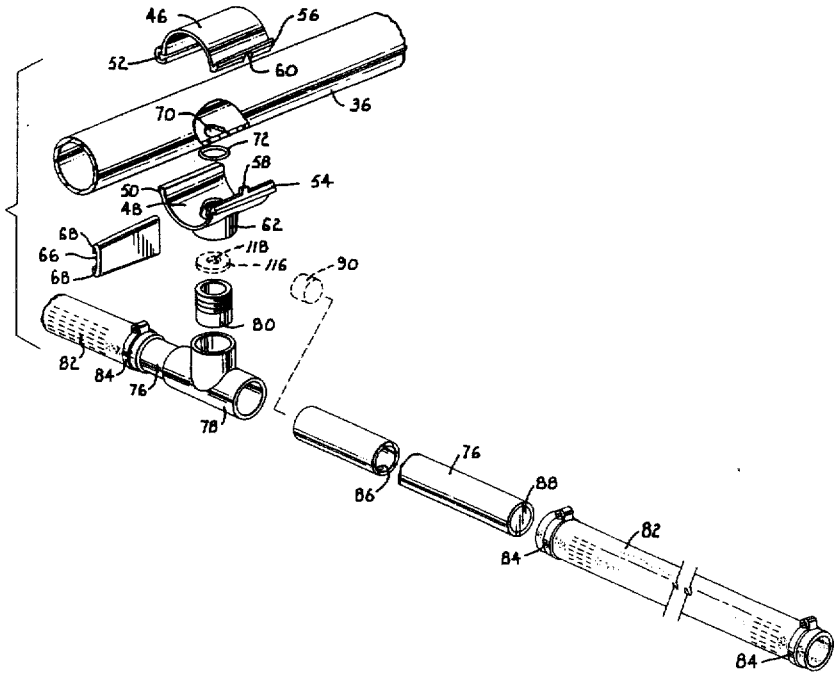

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–18 is confirmed.

New claims 19–21 are added and determined to be patentable.

*19. In a waste water aeration system having a submerged plastic pipe supplied with air under pressure, the improvement comprising:*

*means for providing an outlet port in said pipe for discharging air therefrom;*

*a mounting saddle comprising first and second saddle sections, said first saddle section being plastic and having an outlet fitting thereon;*

*means for clamping said first and second saddle sections on the pipe with said outlet fitting in registration with said outlet port to receive air therefrom and with said saddle sections surrounding said pipe for structural reinforcement thereof at the outlet port location;*

*a plastic diffuser Tee fitting providing a flow passage therethrough and having an inlet and a pair of axially aligned outlets;*

*means for establishing a threaded connection between said outlet fitting and the inlet of said diffuser Tee fitting to mount the diffuser fitting with said flow passage disposed to receive air from the outlet fitting; and*

*an elongate tubular plastic diffuser connected with each outlet of said diffuser Tee fitting in a manner to receive air from said flow passage, each diffuser having means for discharging air into the waste water in bubbles and said diffusers extending horizontally in opposite directions from the outlets of said Tee fitting.*

*20. Aeration apparatus for a waste water treatment system having a submerged plastic pipe presenting an air outlet port, said aeration apparatus comprising:*

*a pair of saddle sections applicable to the pipe in surrounding relationship thereto, one of said saddle sections being plastic and having an internally threaded outlet spout;*

*means for clamping said saddle sections on the pipe with said outlet spout communicating with said port to receive air therefrom and with the saddle sections surrounding the pipe to provide structural reinforcement therefor;*

*means for sealing said spout to the pipe;*

*an externally threaded plastic pipe nipple threaded into said outlet spout;*

*a plastic diffuser fitting connected to said nipple to receive air therefrom; and*

*at least one elongate tubular plastic diffuser connected to said diffuser fitting to receive air therefrom and discharge the air in bubbles into the waste water for aeration thereof, said diffuser extending generally horizontally from the diffuser fitting and applying vibrational loads to the fitting and pipe when air is discharged from the diffuser into the waste water.*

*21. In a waste water treatment system having a plurality of plastic air lateral pipes submerged in waste water in a basin and a plurality of elongate tubular diffusers for discharging air bubbles into the basin, an improved diffuser mounting arrangement comprising;*

*a pair of complementary saddle sections applicable to each air lateral pipe in surrounding relationship thereto;*

*a threaded plastic outlet spout on one of said saddle sections;*

*an air outlet port in one of the air lateral pipes;*

*means for clamping said saddle sections on said one pipe with said spout in communication with said port to receive air therefrom and with said saddle sections surrounding said one pipe to structurally reinforce it;*

*a plastic diffuser fitting having a threaded plastic conduit which may be threaded to said outlet spout to receive air therefrom, said diffuser fitting having a body presenting a flow passage communicating with said conduit to receive air therefrom; and*

*means for connecting at least one of the diffusers with said diffuser fitting to mount the diffuser thereon in communication with said flow passage with the diffuser extending generally horizontally from the diffuser fitting, said connecting means comprising a plastic tube connected with said one diffuser and having a solvent weld connection with said diffuser fitting.*

* * * * *